US005094191A

United States Patent [19]

Garkawe et al.

[11] Patent Number: 5,094,191

[45] Date of Patent: Mar. 10, 1992

[54] STEAM GENERATING SYSTEM UTILIZING SEPARATE FLUID FLOW CIRCUITRY BETWEEN THE FURNACE SECTION AND THE SEPARATING SECTION

[75] Inventors: Michael Garkawe, Madison; Roger A. Soltys, Pittstown, both of N.J.

[73] Assignee: Foster Wheeler Energy Corporation, Clinton, N.J.

[21] Appl. No.: 648,775

[22] Filed: Jan. 31, 1991

[51] Int. Cl.[5] ..... F22B 1/00

[52] U.S. Cl. ..... 122/4 D; 122/6 A; 122/235.12

[58] Field of Search ..... 122/4 D, 6 A, 235.12; 110/245

[56] References Cited

U.S. PATENT DOCUMENTS

| | | | |
|---|---|---|---|
| 4,394,849 | 7/1983 | Pratt et al. . | |
| 4,469,050 | 9/1984 | Korenberg . | |
| 4,475,472 | 10/1984 | Adrian et al. | 122/4 D |
| 4,615,715 | 10/1986 | Seshamani . | |
| 4,651,653 | 3/1987 | Anderson et al. | 122/4 D |
| 4,708,092 | 11/1987 | Engstrom | 122/4 D |
| 4,732,113 | 3/1988 | Engstrom | 110/245 |
| 4,746,337 | 5/1988 | Magol et al. . | |
| 4,813,479 | 3/1989 | Wahlgren . | |
| 4,823,740 | 4/1989 | Ohshita et al. | 122/4 D |
| 4,880,450 | 11/1989 | Magol et al. . | |
| 4,932,363 | 6/1990 | Kuivalainen | 110/245 |
| 4,951,611 | 8/1990 | Abdulally | 122/4 D |
| 4,969,930 | 11/1990 | Arpalahti . | |

FOREIGN PATENT DOCUMENTS 8302935-5 2/1985 Sweden .

*Primary Examiner*—Henry C. Yuen

*Attorney, Agent, or Firm*—Marvin A. Naigur; Charles L. Willis; Warren B. Kice

[57] ABSTRACT

A fluidized bed steam generating system in which a duct is disposed between a furnace outlet and a separator inlet. The duct is formed by first and second wall panels which are comprised of a plurality of parallel tubes extending perpendicular to the direction of the flow of the combustion gases. The tubes comprising the wall panels are bent and welded to a fin extending from corresponding portions of adjacent tubes to form a gas tight structure. The ends of the tubes are connected in fluid flow communication with first and second headers which enables cooling fluid to flow through the tubes for recovering heat from the combustion gases as they flow from the furnace into the separator.

9 Claims, 1 Drawing Sheet

STEAM GENERATING SYSTEM UTILIZING SEPARATE FLUID FLOW CIRCUITRY BETWEEN THE FURNACE SECTION AND THE SEPARATING SECTION

BACKGROUND OF THE INVENTION

This invention relates to a fluidized bed steam generating system and, more particularly, to such a system which includes a separate fluid flow circuitry between the furnace section and the separating section.

Fluidized bed combustion systems in connection with separators are well known. In these arrangements, air is passed through a bed of particulate fuel, possibly coal, wood or dehydrated sewage sludge, to fluidized the bed, and thereby, effectuate high combustion efficiency at a relatively low temperature. This process, however, results in flue gases which retain a large amount of fine particulates. The gas stream is therefore passed into a separator which separates the particulates from the gas and recycles them back into the bed.

In conventional steam generating systems, the passage between the furnace and the separator is usually defined by a relatively expensive, high temperature, refractory-lined duct due to the extreme temperature of the flue gases.

This duct is either left relatively thin due to the expense and weight of the refractory material which results in excessive heat losses to the environment, thereby reducing the system's efficiency, or it is made relatively thick which adds to the bulk, weight and cost of the separator. Even when the duct is thick, all the heat losses cannot be prevented since perfect insulation would raise the duct's temperature to an unacceptable degree.

A further problem associated with the use of a refractory-lined duct is the lengthy time required to warm the walls before putting the system on line to eliminate premature cracking of the refractory material. This lengthy delay is inconvenient and adds to the cost of the process.

For relatively small steam generating systems, these problems can be prevented by forming the duct directly out of the walls of the furnace and separator. This is accomplished by bending a plurality of cooling tubes of each device out of their planes to form both an outlet and inlet which can be welded together. This process is not feasible in larger systems due to the engineering requirement that the duct leading into the separator be several feet in length in order to maintain an acceptable separator collection efficiency. Further, this process is complex and expensive due to the elaborate bending patterns required.

SUMMARY OF THE INVENTION

It is therefore an object of the present invention to provide a steam generating system in which heat losses are reduced to increase the efficiency of the system.

It is a further object of the present invention to provide a steam generating system of the above type in which expensive, high temperature, refractory-lined ductwork is minimized.

It is a still further object of the present invention to provide a steam generating system of the above type in which the gas stream is passed from a furnace into a separator.

It is still a further object of the present invention to provide a steam generating system of the above type in which the steam generating system can be put into use relatively quickly without any significant warm up period.

It is a still further object of the present invention to provide a steam generating system of the above type in which the efficiency of the steam generating system is increased by transferring heat from a duct connecting the furnace and the separator to a power generating system.

It is a still further object of the present invention to provide a steam generating system of the above type in which the duct between the furnace and separator can be maintained at the same temperature as the furnace and separator to reduce the thermal stresses in the system.

Toward the fulfillment of these and other objects the steam generating system of the present invention utilizes a duct between the furnace and the separator which is formed of walls comprising a plurality of parallel tubes extending perpendicular to the direction of the gas flow. The tubes are welded together with intervening fins to form an air-tight structure. The ends of the tubes are connected to headers which pass cooling water, or steam, through the tubes. The headers are connected via pipes to a steam drum and a steam header which control the flow through the tubes and collect steam from the tubes for further use.

BRIEF DESCRIPTION OF THE DRAWINGS

The above brief description as well as further objects, features an advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
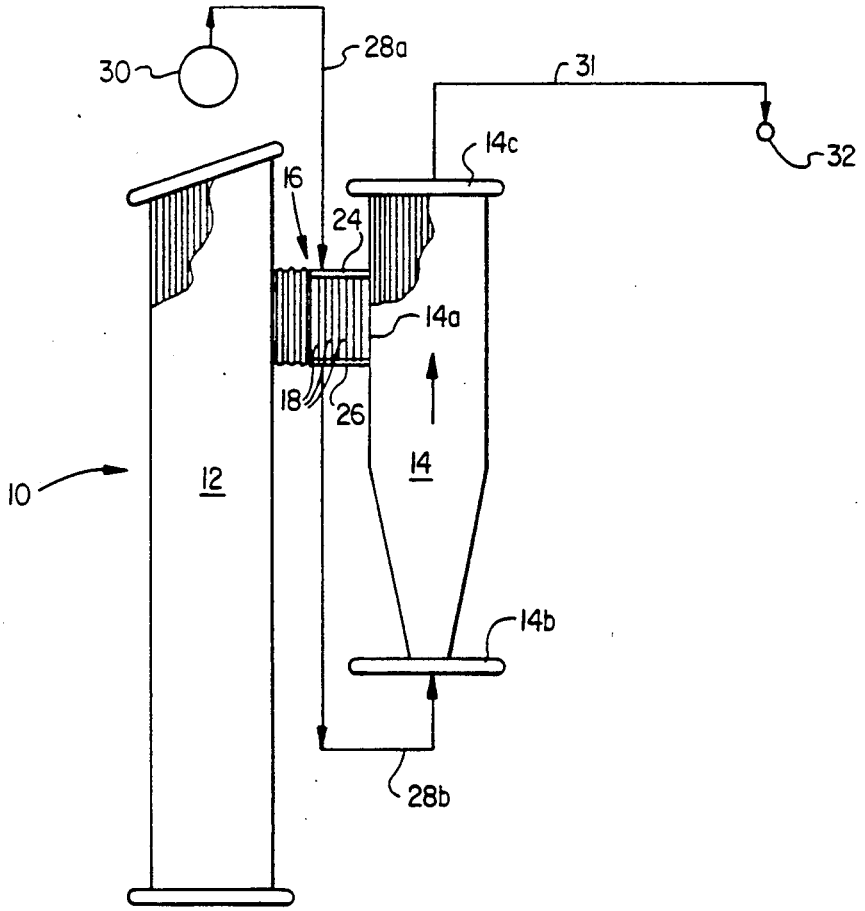
FIG. 1 is a schematic view of the steam generating system of the present invention.
Figure 2:
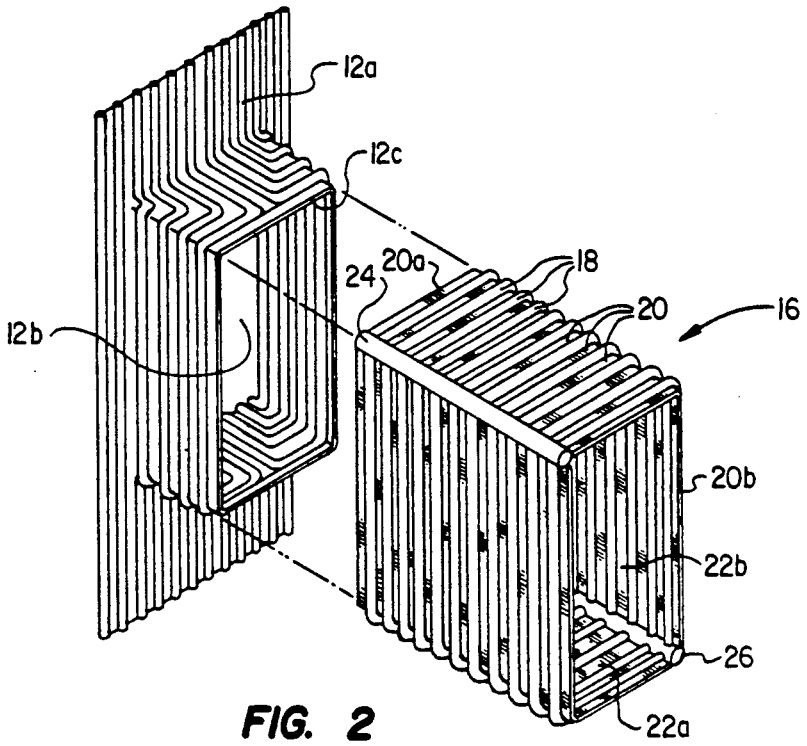
FIG. 2 is an enlarged perspective view of a duct in the system of FIG. 1.

Referring to FIG. 1 of the drawings, the reference numeral 10 refers in general to a steam generating system which includes a furnace 12 and a separator 14. A duct 16 connects the rear wall 12*a* of the furnace 12 to the front wall 14*a* of the separator 14, and the walls of the duct 16 are formed by a group of spaced, parallel, hollow tubes 18. As shown in FIG. 2, a fin 20 is welded to, and extends from, diametrically opposed wall portions of each tube 18 and between the adjacent walls of each adjacent pair of tubes 18. Each fin 20 extends for the entire length of each pair of tubes 18 thus forming two air-tight finned tube panels 22*a* and 22*b*. As shown in FIG. 1, the walls of both the furnace 12 and the separator 14 are formed by finned tube panels in a like manner to the walls of the duct 16.

The tubes 18 forming the panel 22*a* are connected at their upper ends to an upper header 24, extend downwardly vertically from the upper header 24, are bent 90° in their mid-sections and are connected at their other ends to a lower header 26, so that the panel 22*a* creates the bottom and one side of the duct 16. The tubes 18 forming the panel 22*b* extend horizontally from the upper header 24, are bent 90° downwardly in their mid-sections and are connected to the lower header 26, so that the panel 22b forms the top and the other side of the duct 16. The respective ends of all the tubes 18 are thus connected to the headers 24 and 26 so that fluid can flow from the upper header 24 through the tubes 18 and into the lower header 26.

A pipe, or pipes 28a, shown schematically in FIG. 1, extends upwardly from the upper header 24, and a pipe, or pipes 28b, extends downwardly from the lower header 26. The pipes 28a are connected to a vessel 30, which may be in the form of a steam drum or a header, and the pipes 28b are connected to a header 14b disposed at the lower end of the separator 14. It is understood that the vessel 30 can be a source of cooling fluid, such as water, steam or a mixture of both, which passes from the pipes 28a into the upper header 24, through the tubes 18, and into the lower header 26 before being discharged, via the pipes 28b, into the header 14b. From the header 14b, the fluid passes upwardly through the length of the tubes forming the walls of the separator 14, before discharging into a header 14c disposed at the upper end of the separator 14. A pipe, or pipes 31, connects the header 14c to a vessel 32, which may be in the form of a steam drum or a header.

Referring to FIG. 2, the finned tube rear wall 12a of the furnace 12 contains a gas outlet 12b in the upper portion of the furnace 12 for directing furnace gases out of the furnace 12. This furnace outlet 12b is formed in a conventional manner by bending a portion of the tubes of the wall 12a 90° out of the plane of the furnace wall 12a, then outwardly, downwardly and around to define the outlet 12b, and finally back into the plane of the wall 12a. Although not depicted in the drawings in detail, it is understood that the separator 14 contains a gas inlet formed by bending a portion of the tubes comprising the finned tube front wall 14a of the separator 14 out of the plane of the separator wall to form an opening in a similar manner.

The duct 16, as formed by the finned tube panels 22a and 22b, is connected to the rear wall 12a of the furnace 12 by welding a fin edge 20a of the duct 16 to a fin edge 12c of the furnace outlet 12b as depicted schematically in FIG. 2. Similarly, the duct 16 is connected to the front wall 14a of the separator 14 by welding a fin edge 20b of the duct 16 to the inlet (not shown) formed in the wall of the separator 14.

In operation, fuels are combusted in the furnace 12 and the mixture of air and gaseous products of combustion (referred to generally as "the flue gases") passes upwardly in the furnace 12 by natural convection, through the outlet 12b in the upper portion of the furnace 12, and through the duct 16 into the inlet of the separator 14. Simultaneously and continuously, a cooling fluid flows from the vessel 30 into the upper header 24 via the pipes 28a. The cooling fluid then flows into and through the plurality of tubes 18 of both finned tube panels 22a and 22b forming the duct 16. While flowing through the tubes 18, heat from the flue gases passing from the furnace 12 to the separator 14 is transferred into the cooling fluid via the tubes 18, thus warming the cooling fluid. The cooling fluid continues on to the lower header 26 where it then enters the pipes 28b and is passed through the separator 14 and, via the pipes 31, to the vessel 32.

Several advantages result from the foregoing arrangement. For example, the duct 16 of the present invention reduces heat losses and minimizes the requirement for internal refractory insulation. The heat is instead transferred via a cooling fluid through the tubes 18 to increase the efficiency of the steam generating system. Also, the duct 16 can be maintained at the same temperature as the furnace 12 and the separator 14, thereby reducing thermal stresses in the system.

It is understood that several variations may be made in the foregoing without departing from the scope of the present invention. For example, the direction of fluid flow described above can be reversed such that the flow originates from the vessel 32 and continues downward through the separator 14 then upward through the walls of the duct 16 and on to the vessel 30. Furthermore, the fluid flow passing through the tubes 18 of the duct 16 need not flow through the tubes of the separator 14, but can instead pass solely from a header, through the tubes 18 of the duct 16, and back to the originating, or on to a secondary, header.

Other modifications, changes, and substitutions are intended in the foregoing disclosure and although the invention has been described with reference to a specific embodiment, the foregoing description is not intended to be construed in a limiting sense. Various modifications to the disclosed embodiment as well as alternative applications of the invention will be suggested to persons skilled in the art by the foregoing specification and illustrations. Accordingly, it is appropriate that the appended claims be construed broadly and in a manner consistent with the true scope of the invention therein.

What is claimed is:

1. A steam generating system, comprising:

A. a furnace formed at least in part by a plurality of water tubes and having a gas outlet;

B. a separator having a gas inlet; and

C. a duct for directing gases from said furnace outlet to said separator inlet wherein said duct comprises:

(1) a plurality of tubes bent and arranged to connect said furnace outlet and said separator inlet;

(2) means connecting adjacent tubes of said duct to form a gas tight structure; and (3) fluid flow circuit means for circulating fluid through said tubes of said duct independent of any fluid flow through said tubes of said furnace for recovering heat from said gases as they pass through said duct, said fluid flow circuit means comprising:

(a) a first and second vessel;

(b) a first and second header in fluid flow communication with the respective ends of each of said tubes of said duct;

(c) first piping means connecting said first vessel in fluid flow communication with said first header; and (d) second piping means connecting said second vessel in fluid flow communication with said second header.

2. The system of claim 1 wherein said first vessel is a steam drum and said second vessel is a header.

3. A steam generating system, comprising:

A. a furnace formed at least in part by a plurality of water tubes and having a gas outlet;

B. a separator having a gas inlet; and

C. a duct for directing gases from said furnace outlet to said separator inlet wherein said duct comprises:

(1) a plurality of tubes bent and arranged to connect said furnace outlet and said separator inlet;

(2) means connecting adjacent tubes of said duct to form a gas tight structure; and (3) fluid flow circuit means for circulating fluid through said tubes of said duct independent of any fluid flow through said tubes of said furnace for recovering heat from said gases as they pass through said duct, said tubes of said duct divided into first and second panels, such that the tubes forming said first panel are connected at one of their ends to said first header, extend downwardly vertically from said first header, are bent 90° to the horizontal, and are connected at their other ends to said second header; the tubes forming said second panel are connected at one of their ends to said first header, extend horizontally from said first header, are bent 90° to the vertical, and are connected at their other ends to said second header.

4. A heat recovery system, comprising:

A. a furnace for combusting fuel to produce hot gaseous products containing entrained solids, said furnace formed by a plurality of finned tube panels, said furnace panels connected to form a furnace fluid flow circuit for passing fluid through said furnace panels to recover heat from said hot gaseous products in said furnace;

B. a separator for separating said entrained solids from said hot gaseous products, said separator formed by a plurality of finned tube panels, said separator panels connected to form a separator fluid flow circuit for passing fluid through said separator panels to recover heat from said hot gaseous products in said separator; and C. a duct for directing said hot gaseous products from said furnace to said separator, said duct formed by a plurality of finned tube panels, said duct panels connected to form a duct fluid flow circuit independent of said fluid flow circuits of said furnace and said separator for passing fluid through said duct panels to recover heat from said hot gaseous products in said duct and use said recovered duct heat independently of heat recovered from said furnace and said separator.

5. A steam generating system, comprising:

A. a furnace having a gas outlet;

B. a separator having a gas inlet; and

C. means for directing gases from said furnace outlet to said separator inlet, said means comprising:

(1) a plurality of tubes bent and arranged to form a duct connecting said furnace outlet and said separator inlet;

(2) means linking adjacent tubes to form a gas tight structure; and (3) means for connecting said tubes into a fluid flow circuit for recovering heat from said gases as they pass through said duct, said fluid flow connecting means comprising:

(a) a first and second vessel, (b) a first and second header in fluid flow communication with the respective ends of each of said tubes, (c) a first piping means connecting said first vessel in fluid flow communication with said first header, and (d) second piping means connecting said second vessel in fluid flow communication with said second header.

6. The system of claim 5 wherein said first vessel is a steam drum and said second vessel is a header.

7. The system of claim 5 wherein said tubes are divided into first and second panels, the tubes forming said first panel are connected at one of their ends to said first header, extend downwardly vertically from said first header, are bent 90° to the horizontal, and are connected at their other ends to said second header; the tubes forming said second panel are connected at one of their ends to said first header, extend horizontally from said first header, are bent 90° to the vertical, and are connected at their other ends to said second header.

8. The system of claim 5 wherein said linking means comprises a fin extending from corresponding portions of adjacent tubes.

9. The system of claim 5 wherein said tubes extend perpendicular to the direction of the flow of said gases.

* * * * *